United States Patent [19]

Finn et al.

[11] Patent Number: 5,031,810

[45] Date of Patent: Jul. 16, 1991

[54] KNIFE OR BAYONET SCABBARD

[75] Inventors: Charles A. Finn, Oceanside, Calif.; Douglas D. Olson, Chino Valley, Ariz.

[73] Assignee: Val National Corp., DBA Qual-A-Tec, China Valley, Ariz.

[21] Appl. No.: 257,410

[22] Filed: Oct. 13, 1988

[51] Int. Cl.[5] ..... B26B 29/02

[52] U.S. Cl. ..... 224/151; 224/197; 224/232; 224/245; 224/242

[58] Field of Search ..... 224/232, 197, 198, 199, 224/200, 233, 242, 245, 246, 208, 206, 151, 205; 30/151, 143, 164; 248/37.6

[56] References Cited

U.S. PATENT DOCUMENTS

| | | | |
|---|---|---|---|
| 2,387,900 | 10/1945 | Hartwell | 224/232 |
| 2,527,710 | 10/1950 | Davidson, Jr. | 224/232 |
| 2,783,536 | 3/1957 | McQueary | 224/253 |
| 4,114,787 | 9/1978 | Rosenkaimer | 224/232 |
| 4,211,003 | 7/1980 | Collins | 224/232 |
| 4,805,819 | 2/1989 | Collins | 224/232 |

*Primary Examiner*—Linda J. Sholl

*Attorney, Agent, or Firm*—Wagner & Middlebrook

[57] ABSTRACT

An improved knife or bayonet scabbard of rigid material including a body and a clip. A swivel connection between the two allows limited rotation of the body with respect to the clip when the clip is extended for belt wearing. The body is restricted from rotation when the clip is realigned to an aligned position for inverted wearing as on the chest. The body includes an integral catch on one side of the blade receiving opening and an internal spring on the opposite side for biasing the blade of the knife toward the catch. An auxiliary flexible loop aids in holding the knife or bayonet in the scabbard.

6 Claims, 5 Drawing Sheets

FIG. 1
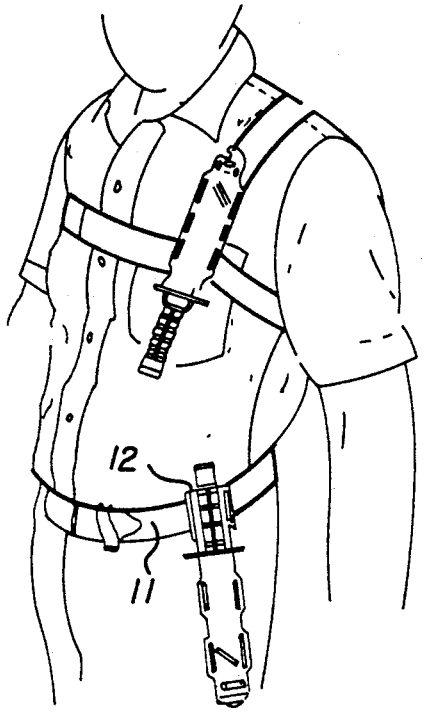
FIG. 2
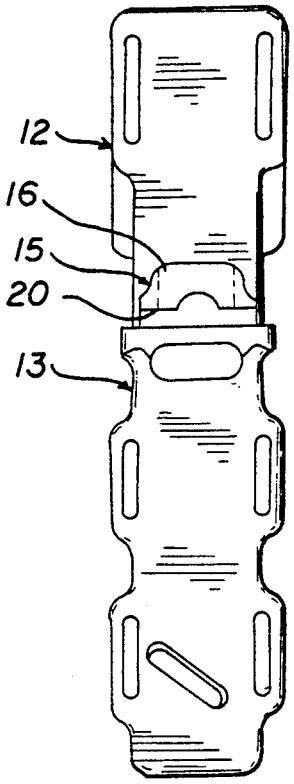
FIG. 4
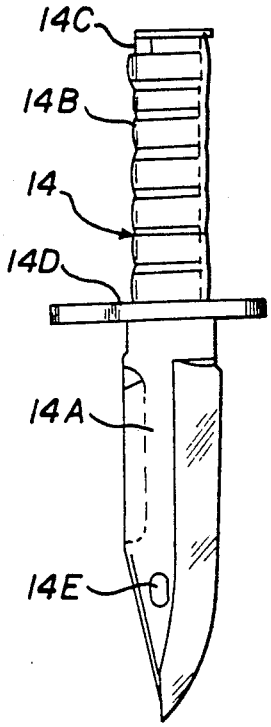
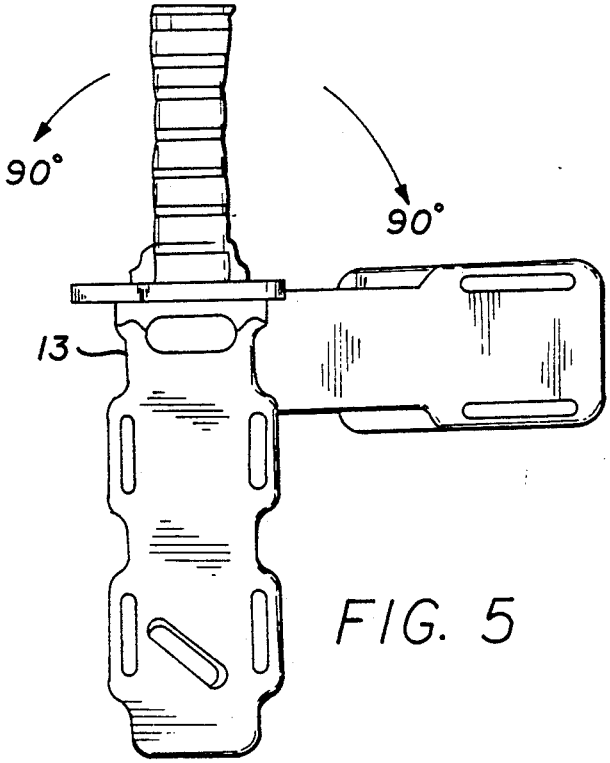
FIG. 5
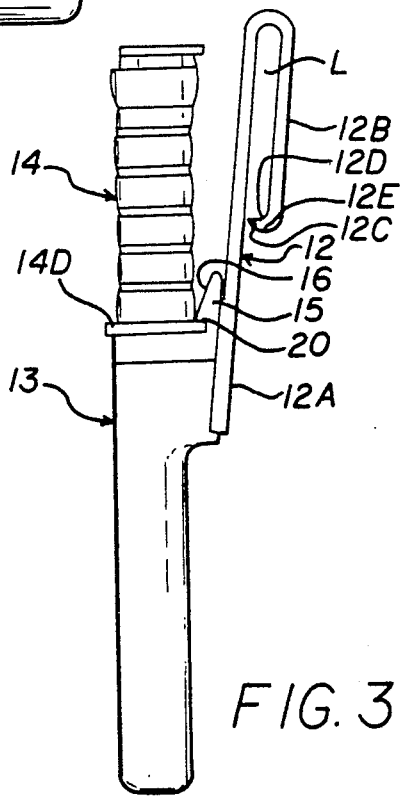
FIG. 3

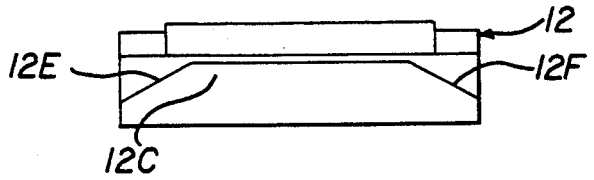
FIG. 9
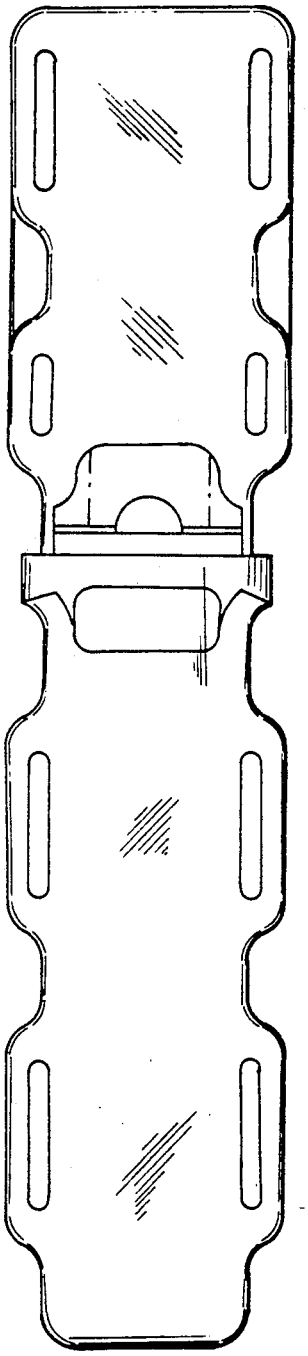
FIG. 8
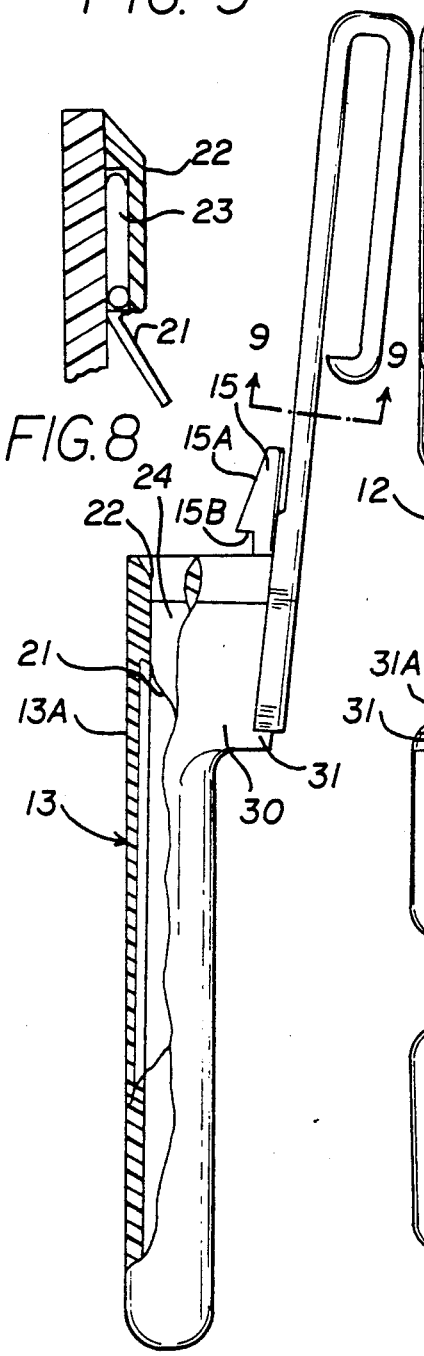
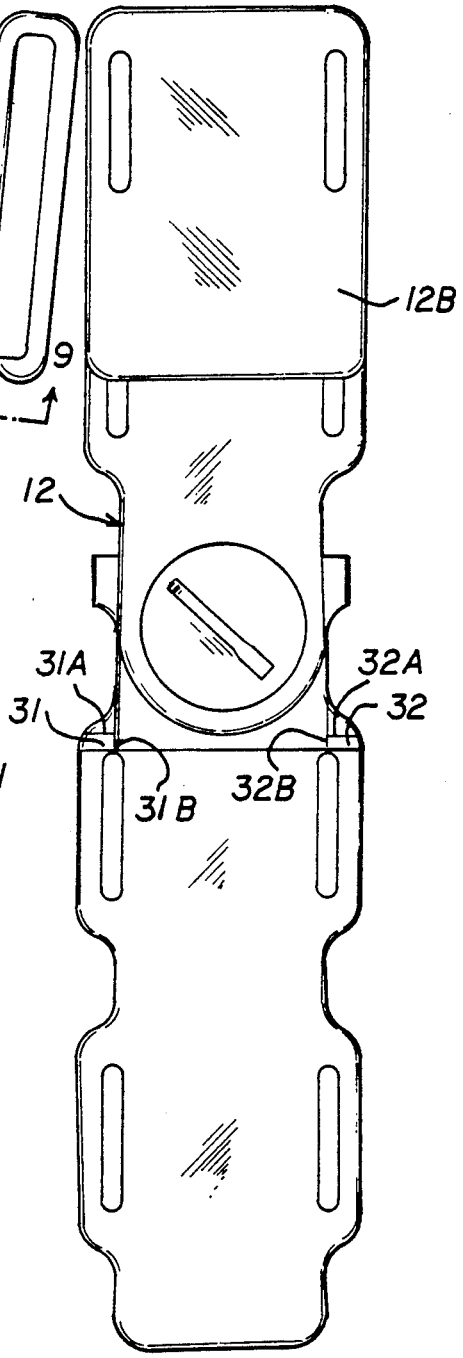
FIG. 6 FIG. 7 FIG. 10

FIG. 12
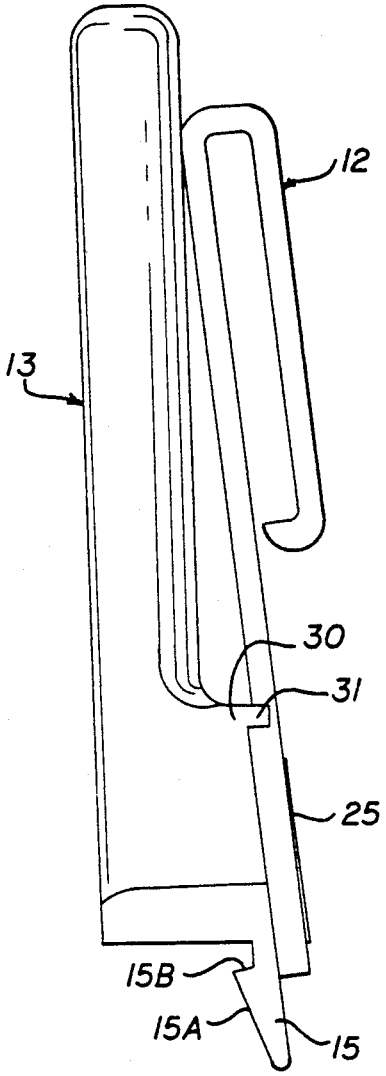
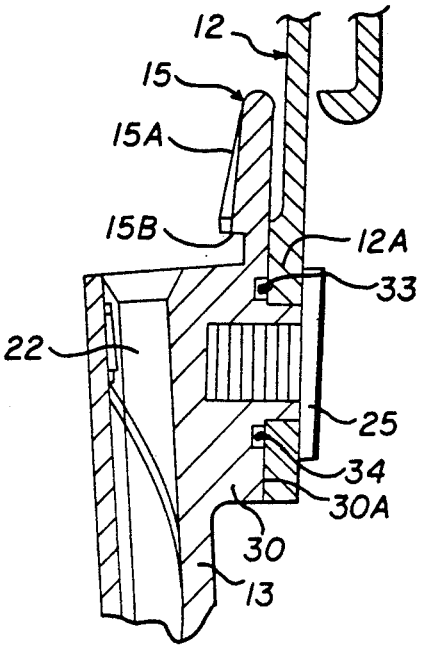
FIG. 15
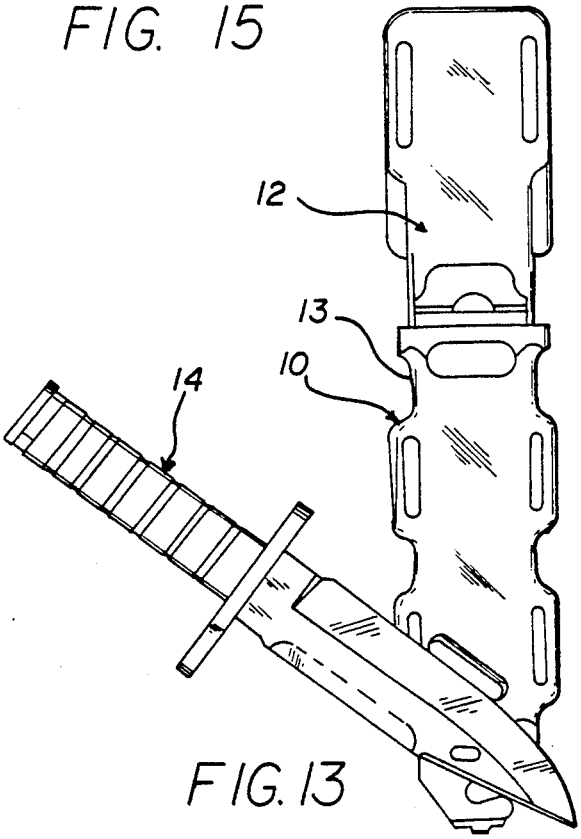
FIG. 13
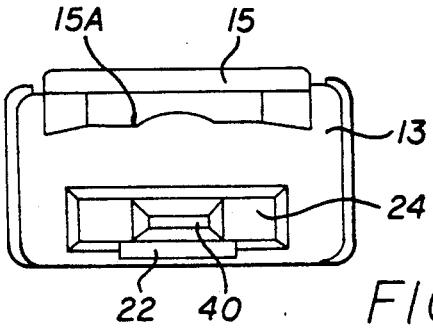
FIG. 11

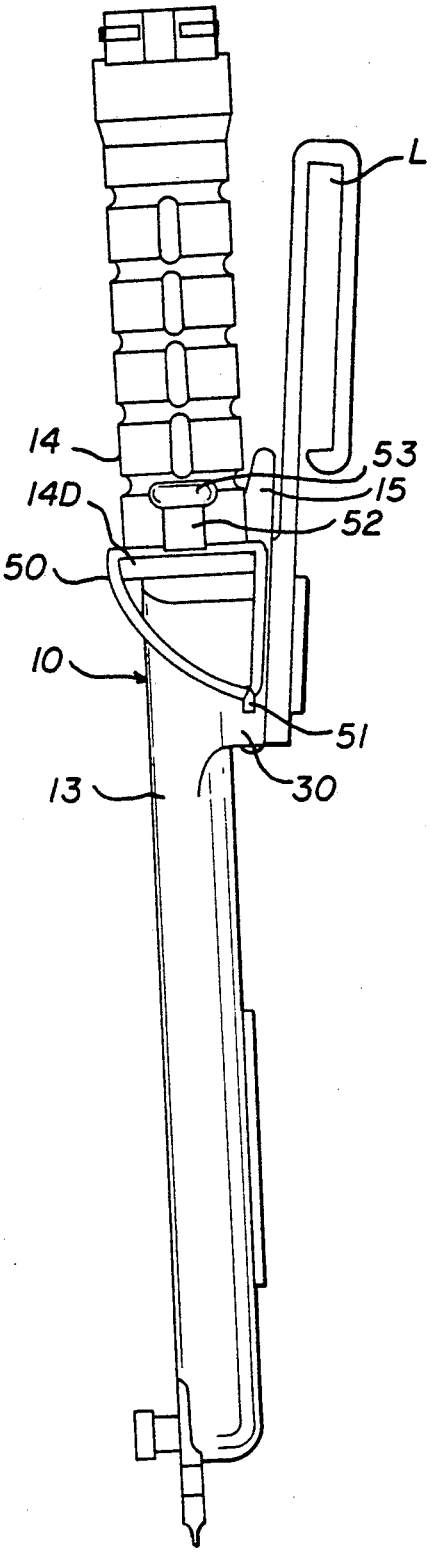
FIG. 16
FIG. 17
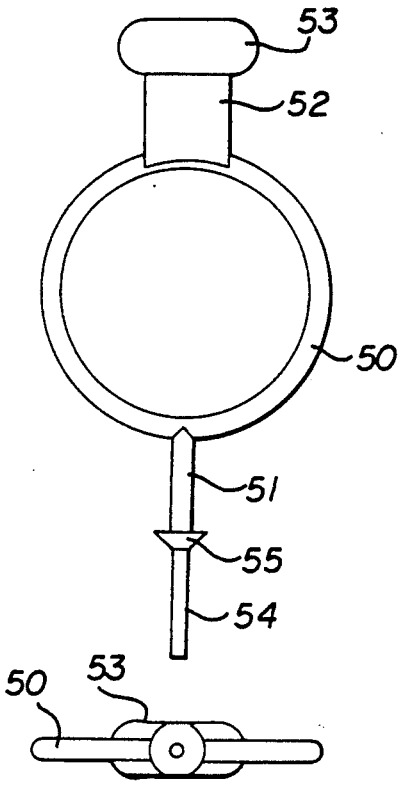
FIG. 18
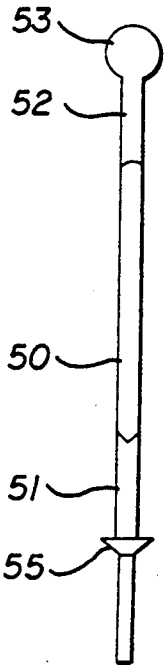
FIG. 19

KNIFE OR BAYONET SCABBARD

REFERENCE TO RELATED APPLICATIONS

This application discloses and claims an improvement in the bayonet scabbard disclosed and claimed in U.S. patent application, Ser. No. 07/025,334 filed Mar. 13, 1987 now U.S. Pat. No. 4,821,256 granted Apr. 18, 1989 and of the design application Ser. No. 06/766,101 filed Aug. 15, 1985 now U.S. Pat. No. D301396.

FIELD OF THE INVENTION

This invention relates to knife or bayonet sheaths or scabbards.

BACKGROUND OF THE INVENTION

In the art of knife sheathes or scabbards, recently the use of rigid molded plastic materials to house knives, particularly military all-purpose knives has reached wide acceptance. Examples of such scabbards are illustrated in the above referenced patent applications. Rigid plastic provides good protection for knife blades, is not affected by water and most substances encountered in use and provides an attractive yet rugged and reliable scabbard material. A rigid scabbard also allows its cooperation with the knife when the knife and scabbard have mating pivots to provide a wire, cable and strap cutter. Such a system is also disclosed in the patent application No. 07/025,334 referenced above. Metal clips are often used to provide belt loops to allow the scabbard to be attached to and to be carried on a belt.

One of the problems, however, is that such clips tend to properly hold the scabbard and knife vertically on the belt which is fine for a standing position but troublesome when sitting. Any pivoting systems heretofore have allowed too much movement as in the case of pivoting holsters for handguns.

Another problem with existing sheaths or scabbards is that they are not well adapted to inverted carrying. First, they are not usually suited to attachment to a vertical or cross chest strap. Secondly, they often do not have a positive lock to insure that an inverted knife remains in place yet can be rapidly removed and silently. Certain military operations require inverted carrying but not at the expense of reliability.

DESCRIPTION OF INVENTION

Faced with the continuing need for improved knife and bayonet scabbards, we have invented a new scabbard which secures the scabbard and knife or bayonet to the belt of a wearer for active movement without danger of becoming disengaged unintentionally but allows the rapid removal by a single swift motion in a few seconds.

We also have designed an improved scabbard which allows pivoting of the blade carrying body with respect to the clip by 180 degrees or thereabout to allow the wearer to sit while wearing the scabbard on his belt without interference by the scabbard and its knife or bayonet.

The same scabbard allows the wearing of the scabbard in inverted position, as from a chest harness with the scabbard body rigid with respect to the clip for positive location and rapid drawings.

In accordance with another feature of the invention, the knife or bayonet is retained within the scabbard by an internal spring which biases the side of the hand guard of the knife or bayonet under a catch. As arranged, merely the act of grasping the handle of the knife or bayonet and pressing the handle away from the clip releases the knife or bayonet. Return of the blade to the scabbard automatically engages the catch.

One further feature of this invention involves the catch in which it is integral with the scabbard body and located on the opposite main face of the body from the location of the spring.

We have also provided an auxiliary catch in the form of a resilient loop secured to the scabbard body which extends over the hand guard of the knife or bayonet carried in the scabbard to secure it additionally when the wearer is engaged in strenuous activities such as combat parachute jumping.

Basically, the preferred embodiment comprises a scabbard body which is molded from relatively rigid plastic material as is the clip. Each has a circular mating attachment region. A screw fastener holds the two parts together. A pair of stops are molded into the body and are upstanding on one major face of the scabbard body. The stops are positioned below the attachment point of the clip and body and on opposite edges of the body whereby the clip may be rotated approximately 90 degrees in each direction from an aligned extended position with respect to the body.

The stops also define a short channel of width corresponding to the width of the clip near the attachment portion whereby the clip may be removed or loosened, reversed in direction to be side by side with the body for inverted carrying and relocked into position.

These and other features of the invention may be understood from the following detailed description.

BRIEF DESCRIPTION OF DRAWING

The specification defines the best mode known by us in carrying out the invention which is illustrated in the drawings in which:

FIG. 1 is a perspective view of an individual wearing the scabbard of this invention in two ways, on his belt and on his chest;

FIG. 2 is a front elevational view of the preferred embodiment of this invention;

FIG. 3 is a side elevational view of the embodiment of FIG. 2 with a bayonet in place;

FIG. 4 is a side elevational view of a typical bayonet or all purpose military knife which may be carried in this invention;

FIG. 5 is a front elevational view of the scabbard and bayonet of FIG. 3 illustrating the pivotal capability of the body and clip;

FIG. 6 is an enlarged front elevational view of the scabbard of another embodiment of this invention with a modified clip;

FIG. 7 is a side elevational view of the embodiment of FIG. 6 with portions broken away to show the internal bias spring;

FIG. 8 is an enlarged fragmentary view of the spring securing detail of the embodiment of FIG. 6 and 7

FIG. 9 is a sectional view of the clip taken along lines 9—9 of FIG. 8;

FIG. 10 is a rear elevational view of the embodiment of FIGS. 6–9;

FIG. 11 is a top plan view of the body portion of the embodiment of FIGS. 6–9 viewed through the blade receiving opening of the scabbard;

FIG. 12 is a side elevational view of the scabbard of this invention with the clip shown reversed and the scabbard body in an inverted position;

FIG. 13 is a front elevational view of the embodiment of FIG. 2 with a cutter of the type disclosed in the patent application Ser. No. 07/025,334, referenced above, installed;

FIG. 15 is a vertical sectional view of a rotatable attachment means and stop of this invention;

FIG. 16 is a side elevational view of a version of this invention including an auxiliary catch for holding the knife or bayonet in place in the form of a tabbed resilient loop; and FIGS. 17, 18, and 19 are orthoginal views, namely a front elevational view, a bottom plan view and a side elevational view, respectively of the tabbed loop catch of FIG. 16.

DETAILED DESCRIPTION OF INVENTION

Figure 14C:
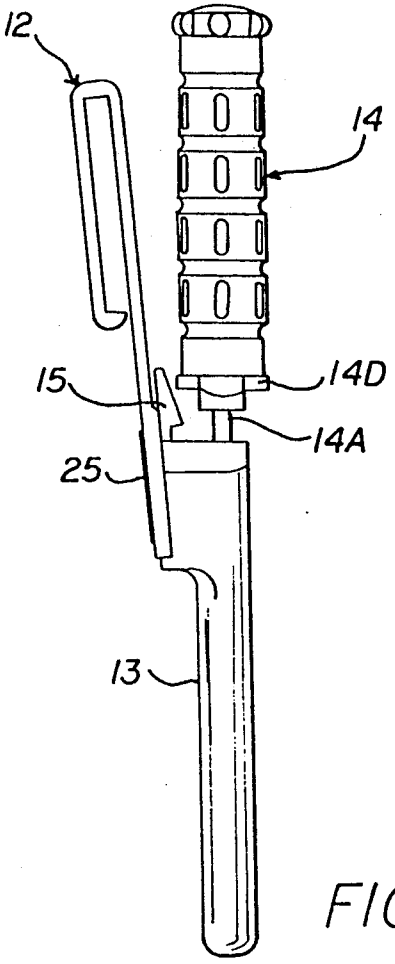
FIG. 14 is a series of three front elevational views showing a knife holstered (a), being released (b) and being withdrawn (c)
Figure 14B:
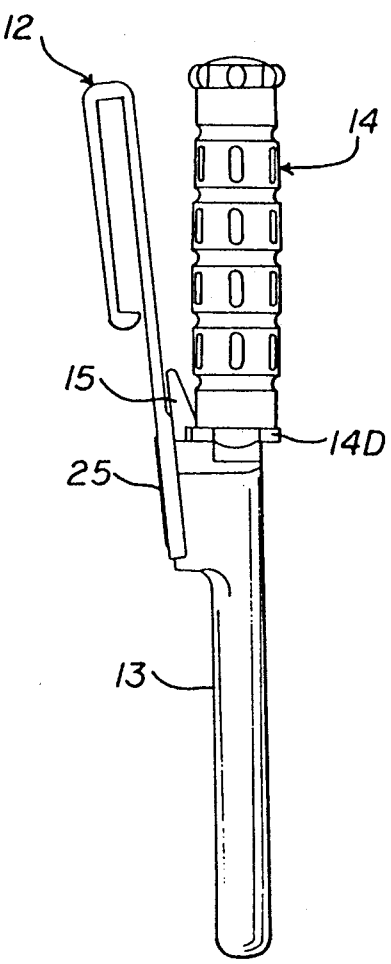
Figure 14A:
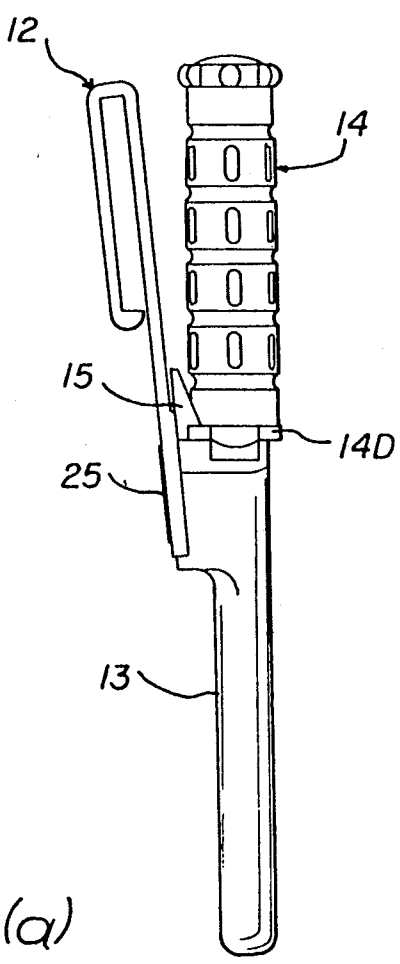

This invention is best illustrated in use in FIG. 1 which shows one scabbard, generally designated 10 worn on a belt 11 by clip 12 and in a second configuration, designated as scabbard 10A, identical to scabbard 10, but readjusted to be worn on his chest. This figure shows the two most common ways of wearing a knife or bayonet. The scabbard 10A, although identical, in the belt worn configuration 10 allows up to 180 degrees of swing of the scabbard body 13 with respect to the clip 12 as illustrated at one extreme position in FIG. 5. In the chest worn configuration 10A, the scabbard body 13 is locked from rotation, merely by the fact of the reversal of the clip 12 as is described below.

The scabbard 10 and its mating bayonet 14 are illustrated in FIGS. 2, 3 and 4 respectively. The scabbard body 13 is similar to the scabbard body described in the copending patent application No. 4,821,256 referenced above with the important exception that it includes an integral catch 15 with a tapered leadin surface 16 and a catch surface 20. The catch 15 is located adjacent to the clip 12 which includes an attachment portion 12A and a reentrant belt loop spring portion 12B. The belt loop portion 12B terminates with a tapered leadin portion or surface 12C and a catch portion 12D. As so designed, the clip 12 may be easily slipped over a belt 11 by dragging the attachment portion 12A downward over a belt, spreading the belt loop portion 12B until the belt 11 enters the belt loop L to spread the clip 12 using the second and third tapers 12E or F as illustrated in FIGS. 2 and 9, particularly in FIG. 9.

The bayonet 14, as it appears in FIG. 4, includes a blade 14A, a handle 14B, a latch assembly 14C and a hand guard 14D as is illustrated in the patent referenced above. An oval opening 14E through the blade is used to engage a round post on the scabbard cutter to turn the scabbard and bayonet into an effective wire, cable and strap cutter. These features are better described and are claimed in the above mentioned patent.

Referring now specifically to FIG. 3, in conjunction with FIGS. 7 and 8 and 9, the function and operation of the integral catch 15 may be discussed and understood. The catch 15 is molded integrally with the body 10 and includes a tapered leadin section 15A and a catch portion 15B dimensioned to engage the hand guard 14D of a knife or bayonet contained in the scabbard 10.

The tapered leadin section 15A forces the bayonet 14 outward toward the outer major face 13A of the body 13 against the biasing force of internal spring 21 which appears in FIGS. 7 and 8 but is unshown in FIG. 3. As the hand guard 14D slips past the catch 15 it is trapped behind the catch surface 15B by the biasing force of the internal spring 21. Spring 21 is in the form of an arc with both ends free to move slightly to accommodate the width of the blade 14A. The outer end of the spring 21 is captured beneath an internal cover plate 22 on a spring end ring 23, best seen in FIG. 8.

The three tapered surfaces 12C, 12E and 12F of the clip 12 are all clearly shown in FIG. 9 which cooperate in the attachment of the clip to a belt. This configuration of the belt loop portion 12B of clip 12 (see FIG. 3) insures rapid attachment and detachment of the scabbard from a belt and the resiliency of the clip 12 and the broad surface of the catch 12D of FIGS. 3 and 7 insure reliable attachment during use.

FIG. 10 shows the rear face of the scabbard 10 and the rear major face of the body 13 as well as the pivotal attachment of the clip 12 to the body 13. Where the front major face of the body 13 is ordinarily planar as illustrated in FIG. 7, the rear major face includes a boss portion 30 of FIG. 7 and a pair of dual directional stops 31 and 32. These stops which are integral with the body 13 are positioned to limit rotational movement of the clip to approximately 90 degrees to the left or counterclockwise in FIG. 10 to engage stop surface 31A or to the right or clockwise in FIG. 10 until the edge of the clip 12 engages stop surface 32A.

The operation of the stop surfaces 31A and 32A occurs when the body 13 and clip 12 are in what is termed extended pivotal engagement, i.e. extended in opposite directions from the pivot screw 25. This extended engagement is used when the scabbard is worn on a belt.

When the clip is reversed and rigidly secured to the body and the stop surfaces 31B and 32B engage the sides of the clip rotational portion, the clip 12 and the body 13 are said to be in aligned adjacent position. As will be described below, when the clip 12 is reversed with respect to the body 13, the sides of the clip 12 will rest between the stops 31 and 32 and engage their stop surfaces 31B and 32B to hold the clip rigidly with respect to rotational movement respecting the body 13.

The rotational attachment means 25, preferably comprises a large headed plastic screw, best seen in FIGS. 10 and 15. The screw 25 is in threaded engagement with a mating threaded hole in boss portion 30 of the body 13 on the rear major face of body 13. The boss 30 includes an annular recess 33 in which a friction member 34 in the form of an O ring is locked. The O ring is compressed between the outer surface 30A of boss 30 and the attachment portion 12A of the clip 12. When the screw 25 is fully tightened on boss 30, the O ring 33 is compressed to provide a degree of resistance to rotational of the clip 12 with respect to the body 13.

FIG. 11 as well as FIG. 15 shows the blade receiving cavity 24 of the body 13 with its tapered opening. FIG. 11 also shows that the body 13 preferably has a water drain hole 40.

We have found that the body 13, clip 12 and the screw 25 are all easily molded from the plastic material such as the tough, abrasion resistant and environmental stable product of the E.I. duPont de Nemours Co. of Wilmington, Del. which is sold under the trademark "Zytel".

Now referring to FIG. 16, an additional feature of this invention may be seen. In FIG. 16, a side view of the scabbard 10 shows that a resilient loop 50 extends around the hand guard 14D of bayonet 14. The loop 50 includes one tab 51 which extends through a mating opening in the boss 30 on the body 13 and is secured by means of a resilient conical plug 53 which appears in FIGS. 17, 18, and 19.

The loop 50 includes a second tab 52 with an end handle 53 for easy grasping even while wearing gloves. As may be seen in FIG. 16, the loop securely holds the hand guard 14D from moving upward and by reason of its location on the boss 30 acts as a second biasing means for the hand guard 14D into engagement with the integral catch 15 of the body 13. This gives further reliability to the scabbard and is particularly useful for paratroopers during jump exercises or combat.

Referring now specifically to FIGS. 17–19, at the loop 50 is clear with its two tabs 51 and 52. The conical stop 5 is also visible in each of these figures. An end tail 54 is shown as present in the loop 50 as manufactured from a rubber-like material such as synthetic rubber. The body 13 need only have a molded or drilled hole through the boss 30 of slightly larger diameter than the tab 51. The tail 54 is passed through the hole, the conical stop compresses, passes through the boss 30 and expands again on the opposite side to hold the loop 50 on the body 13. The tail 54 may then be cut off. The scabbard is then ready for use with the additional protection for the knife or bayonet carried.

Altogether we have developed an improved scabbard which provides angular adjustability for normal belt use and rigid connection for chest or other use. The knife or bayonet is secured in place while in use and yet easily removed by mere pressure away from the clip. All parts are molded of quality plastic for low cost, weather and environmental stability in tropic to arctic conditions.

The foregoing constitute the best mode known to us for carrying out this invention. The embodiments shown and described are illustrations only and this invention is not limited to these specific embodiments. Rather, this invention is defined by the following claims including the scope afforded by the doctrine of equivalents.

We claim:

1. A sheath assembly comprising a clip releasably engageable with a supporting belt, a scabbard, a separable pivotal connection between said clip and said scabbard, and stop means for preventing pivotal movement of said clip and scabbard with respect to each other in a first position and for permitting pivotal movement of less than 360 degrees between said clip and scabbard with respect to each other in a second position.

2. A sheath assembly according to claim 1 in which said separable pivotal connection comprises a screw in threaded engagement with a threaded hole in said scabbard and having a head bearing against a surface of said clip.

3. A sheath assembly according to claim 2 in which said stop means comprises a pair of stops integral with said scabbard and spaced apart only sufficiently to receive a portion of said clip between them.

4. A sheath assembly according to claim 1 including additionally means for loosening said pivotal connection to permit relative movement of said clip and scabbard away from each other sufficiently to pass said stop means.

5. A sheath assembly according to claim 1 in which said stop means comprises a pair of stops integral with said scabbard and spaced apart only sufficiently to receive a portion of said clip between them.

6. A sheath assembly according to claim 1 in which said stop means comprises a pair of stops integral with said scabbard and spaced apart only sufficiently to receive a portion of said clip between them when the clip and scabbard are in said first position and including additionally means for loosening said pivotal connection to permit relative movement of said clip and scabbard away from each other sufficiently to pass said stop means; whereby movement of said clip and scabbard to said second position may be effected.

* * * * *

UNITED STATES PATENT AND TRADEMARK OFFICE

CERTIFICATE OF CORRECTION

PATENT NO. : 5,031,810

DATED : July 16, 1991

INVENTOR(S) : Charles A. Finn and Douglas D. Olson

It is certified that error appears in the above-identified patent and that said Letters Patent is hereby corrected as shown below:

Column 5, line 20, replace "5" with --55--.

Signed and Sealed this

First Day of December, 1992

*Attest:*

DOUGLAS B. COMER

*Attesting Officer*

*Acting Commissioner of Patents and Trademarks*